US005186444A

United States Patent [19]

Palmatier et al.

[11] Patent Number: 5,186,444

[45] Date of Patent: Feb. 16, 1993

[54] METHOD AND DEVICE FOR ASSURING ORDERLY WEB TRAVEL IN A FOLDER BY PUNCHING HOLES IN A PAPER WIDTH DIRECTION

[75] Inventors: Roland T. Palmatier, Durham; Michael A. Novick, New Durham; Roger R. Belanger, Dover, all of N.H.

[73] Assignee: Heidelberg Harris GmbH, Heidelberg, Fed. Rep. of Germany

[21] Appl. No.: 908,528

[22] Filed: Jun. 29, 1992

Related U.S. Application Data

[63] Continuation of Ser. No. 684,691, Apr. 11, 1991, abandoned.

[51] Int. Cl.[5] ..... B65H 41/00

[52] U.S. Cl. ..... 270/52.5; 270/21.1; 83/862

[58] Field of Search ..... 270/21.1, 32, 37, 52, 270/52.5; 83/861, 862, 863, 867

[56] References Cited

U.S. PATENT DOCUMENTS

| | | | |
|---|---|---|---|
| 494,233 | 3/1893 | Scott . | |
| 562,986 | 6/1896 | Taylor | 83/863 |
| 565,186 | 8/1896 | Taylor | 83/863 |
| 3,517,589 | 6/1970 | Herd | 270/52 |
| 4,114,869 | 9/1978 | Gladow | 270/37 |
| 4,422,630 | 12/1983 | Trentman | 270/37 |
| 4,601,693 | 7/1986 | Richey | 270/53 |
| 4,842,260 | 6/1989 | McAnelly | 270/52 |
| 4,850,947 | 7/1989 | Brown et al. | 493/365 |

FOREIGN PATENT DOCUMENTS

| | | | |
|---|---|---|---|
| 0117601 | 9/1984 | European Pat. Off. . | |
| 0138422 | 4/1985 | European Pat. Off. . | |
| 2301586 | 6/1973 | Fed. Rep. of Germany | 270/21.1 |
| 3404164 | 8/1985 | Fed. Rep. of Germany . | |
| 8712804 | 1/1988 | Fed. Rep. of Germany . | |
| 2383872 | 11/1978 | France | 270/52 |
| 5467837 | 10/1985 | Japan . | |
| 220678 | 9/1989 | Japan | 270/21.1 |
| 1303838 | 1/1973 | United Kingdom | 83/862 |
| 1605071 | 12/1981 | United Kingdom . | |

*Primary Examiner*—John T. Kwon
*Assistant Examiner*—John Ryznic
*Attorney, Agent, or Firm*—Herbert L. Lerner; Laurence A. Greenberg

[57] ABSTRACT

A method of assuring orderly web travel in a folder includes stamping out of a layered structure formed of mutually superimposed web surface portions, along respective strips thereof, a plurality of tongue-like elements remaining appendant to the web surface portions and projecting through respective holes simultaneously stamped out of the web surface portions so as thereby to hold the web surface portions together at the respective strips thereof; and a device for performing the method.

18 Claims, 3 Drawing Sheets

METHOD AND DEVICE FOR ASSURING ORDERLY WEB TRAVEL IN A FOLDER BY PUNCHING HOLES IN A PAPER WIDTH DIRECTION

This application is a continuation of application Ser. No. 684,691, filed Apr. 11, 1991, now abandoned.

The invention relates to a method and device for assuring orderly web travel in a folder of a printing machine.

Devices have become known heretofore which are mounted on cylinders in folders and act upon paper webs travelling into the respective folders. For example, one or more cutting knives are mounted on the outer cylindrical surface of a cutting cylinder of a pair of cylinders including a grooved cylinder, while one or more rubber beams or bars, depending upon the number of cutting knives, are arranged on the outer cylindrical surface of the grooved cylinder.

From German petty Patent 87 12 804.7, a device has become known, for example, for impressing perforated lines wherein perforating knives are clampable hydraulically in a given position. The perforating knives act upon the web in the folder over the entire width of the web and stamp a sectionwise perforation into the web extending perpendicularly to the travel direction of the web, in accordance with the diameter of the cylinder.

Starting from this state of the art, it is an object of the invention of the instant application to provide a method and device for assuring orderly web travel in a folder to an extent greater than heretofore.

With the foregoing and other objects in view, there is provided, in accordance with the invention, a device for assuring orderly web travel in a folder, comprising at least one cutting cylinder, at least one cutting knife disposed on the cutting cylinder, a grooved cylinder disposed in cooperative engagement with the cutting cylinder, the grooved cylinder carrying at least one rubber beam in a groove formed in the grooved cylinder, the cutting cylinder and the grooved cylinder being contrarotatable so that the cutting knife and the rubber beam are periodically in mutual engagement at a cut-off location, and at least one stamping die disposed in vicinity of the cut-off location for stamping holes out of a layered structure formed of mutually superimposed web surface portions travelling through a nip between the cylinders while leaving a tongue-like element appendant to the web surface portions and projecting through the holes adjacent a location of the web surface portions at which a signature is cut-off by the cutting knife.

An advantage of the foregoing construction of the device according to the invention is that stabilization of the web occurs at the cutting-cylinder/grooved-cylinder pair due to the stamping die or dies punching through the layers of the web which may or may not be folded. The stamping die or dies are arranged, for this purpose, in the vicinity of the cut-off location, so that no additional device is necessary for supporting and operating them. Furthermore the space requirement for the stamping dies is rather minimal, and the stamping dies may be built in afterwards to previously delivered folders. The precise transport of the web which is achievable by the device according to the invention markedly improves the quality of the production.

In accordance with another feature of the invention, the stamping die is located on the cutting cylinder upstream of the cutting knife in the direction of travel of the web surface portions through the nip so as to stamp the holes out of the web surface portions before the cutting knife cuts off the signature.

An advantage of this feature of the invention device is that a tacking of the web layers is effected by the stamping dies before cut-off of the web in the cutting cylinder pair. The stamping dies penetrate the web layers and, due to small tabs or tongues at the edges of the resulting stamped-out holes, which remain appended to the web, the individual layers of the web are hooked together by the projection of the tabs into the holes. A smooth leading edge of signatures then cut from the web is thereby formed.

In accordance with yet an added feature of the invention, the stamping die is located on the cutting cylinder adjacent the cutting knife so as to stamp the holes out of the web surface portions and cut the signature off approximately simultaneously.

In accordance with yet an additional feature of the invention, the stamping die is located on the cutting cylinder downstream of the cutting knife in the direction of travel of the web surface portions through the nip so as to stamp the holes out of the web surface portions after the cutting knife cuts off the signature.

In accordance with a further feature of the invention, there is provided a clamping rail mounted on the outer cylindrical surface of the cutting cylinder, the stamping die being held in the clamping rail.

This offers an economic advantage of being able to retrofit previously delivered machines with the device according to the invention, because the latter can be installed with considerable space-saving.

In accordance with an added feature of the invention, the stamping die is mounted on the cutting cylinder for cooperative engagement with the rubber beam periodically.

Thus, with the rubber beam or bar serving as a cutting underlayer for the cutting knife, a stamping-out of all of the layers of the paper web can be achieved, and the additional use of the rubber beam or bar as underlayer for the stamping operation permits dispensing with the installation of a separate stamping underlayer.

In accordance with an additional feature of the invention, a plurality of the stamping dies are disposed on the outer cylindrical surface of the cutting cylinder for stamping out holes with tongue-like elements or tabs appendant to the web surface portions and projecting through the respective holes along respective strips of the web in surface portions vicinity of the cut-off location.

By suitably spacing individual stamping dies from one another, a web in many layers can intentionally have several holes stamped or punched-out at a side thereof which is located opposite the fold side of the product or signature, if folded, or on each side thereof, if not folded. The stamping at the leading edges of the signature in the travel direction thereof prevents the occurrence of "dog ears" as the signatures enter into transport or conveyor systems located farther downstream.

In accordance with still another feature of the invention, the clamping rail is mounted on the outer cylindrical surface of the cutting cylinder substantially parallel to a rotational axis thereof, and a plurality of the stamping dies are distributed over the length thereof at mutually adjacent locations.

In accordance with another aspect of the invention, there is provided a device assuring orderly web travel in a folder, comprising a first movable member carrying at least one cutting knife, a second movable member cooperatively engageable with the first movable member and carrying at least one beam formed of yieldable material, the first and the second movable members being movable relatively to one another so that the cutting knife and the beam formed of yieldable material are periodically in mutual engagement at a cut-off location along a travel path of a layered structure formed of mutually superimposed web surface portions, and at least one stamping die disposed at another location along the travel path for stamping holes out of the web surface portions along respective strips thereof while leaving a tongue-like element appendant to the web surface portions and projecting through the holes.

In accordance with a further mode of the invention, there is provided, in a method of assuring orderly web travel in a folder, the improvement therein which comprises the step of stamping out of a layered structure formed of mutually superimposed web surface portions, along respective strips thereof, a plurality of tongue-like elements remaining appendant to the web surface portions and projecting through respective holes simultaneously stamped out of the web surface portions so as thereby to hold the web surface portions together at the respective strips thereof.

In accordance with an added mode of the invention, the method includes prior to the stamping step, severing the superimposed web surface portions into respective signatures along the respective strips so that leading ends of the respective signatures are held together by the tongue-like elements projecting through the stamped-out holes.

In regard to severing the superimposed web portions prior to the stamping step, it is noted that the time interval therebetween should be sufficient so that air resistance will not cause the web surface portions to separate.

In accordance with yet a further feature of the invention, there is provided during the stamping step, severing the superimposed web surface portions into respective signatures along the respective strips so that leading ends of the respective signatures are held together by the tongue-like elements projecting through the stamped-out holes.

In accordance with still another feature of the invention, there is provided, after the stamping step, severing the superimposed web surface portions into respective signatures along the respective steps so that leading ends of the respective signatures are held together by the tongue-like elements projecting through the stamped-out holes.

In accordance with still a further feature of the invention, there is provided a step of severing the superimposed web surface portions into respective signatures along the respective strips, and a subsequent step of transporting the thus formed signatures to a further processing location.

In accordance with still an added feature of the invention, there is provided a step of applying a substance to the respective strips at leading edges of the thus formed signatures for causing the leading edges to adhere to one another.

In accordance with still an additional feature of the invention, the substance which is applied is an adhesive.

In accordance with yet another feature of the invention the substance which is applied is water.

In regard to the application of water, it is noted that water will hold the leading edges of superimposed sheets together long enough for them to pass through a folder without fluttering apart.

In accordance with yet an added feature of the invention, there are provided binding pages of the signature together at the strips.

In accordance with a concomitant mode of the invention, there is provided trimming the strips from the respective signatures.

Other features which are considered as characteristic for the invention are set forth in the appended claims.

Although the invention is illustrated and described herein as embodied in a method and device for assuring orderly web travel in a folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
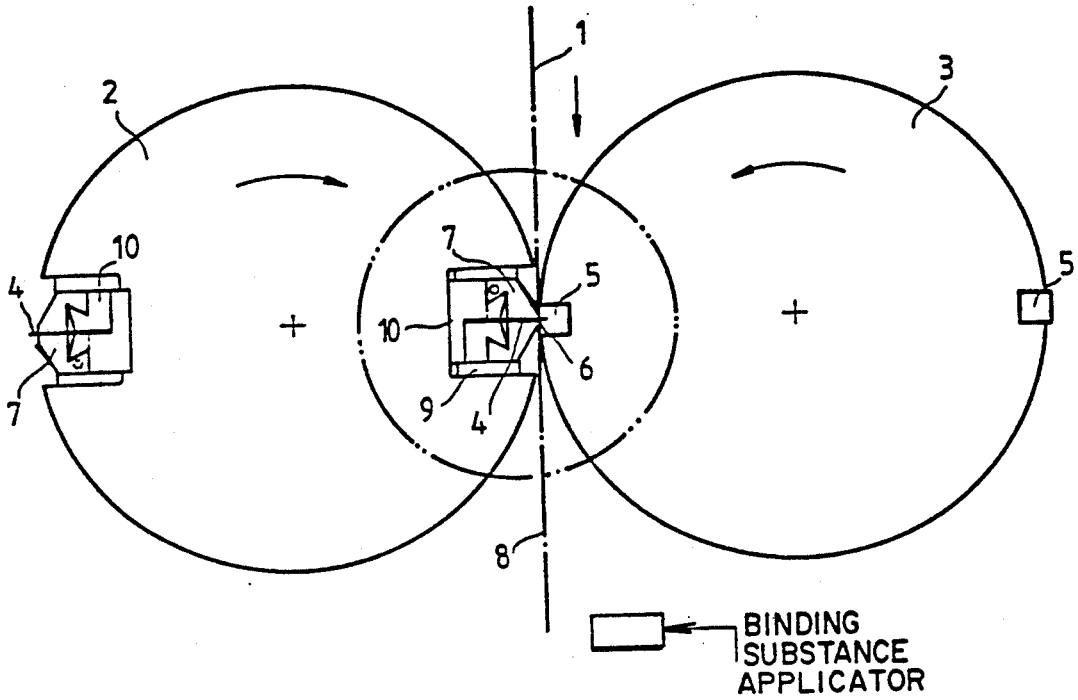
FIG. 2 is an enlarged end view of FIG. 1, with a journal of the cutting cylinder as well as a journal of a grooved or notched cylinder cooperating therewith omitted from the figure.
Figure 3:
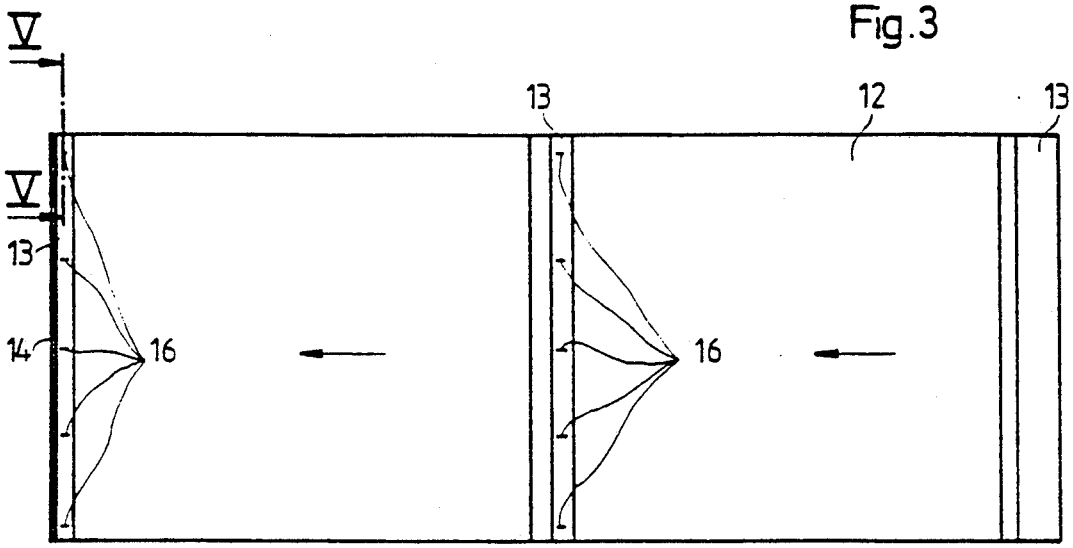
Figure 4:
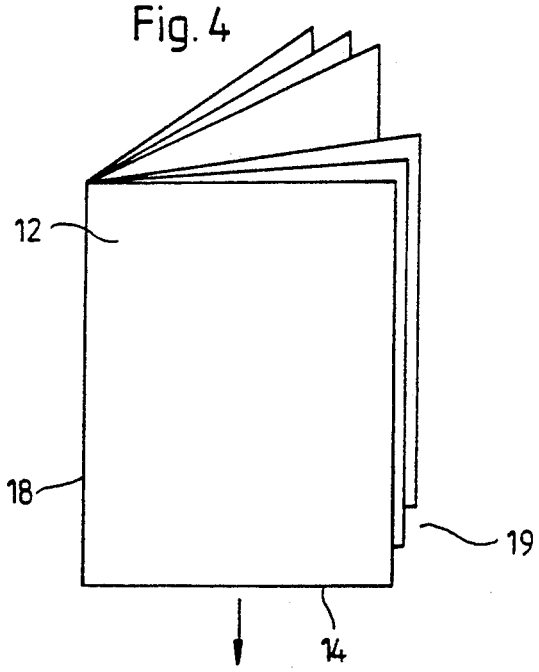
Figure 5:
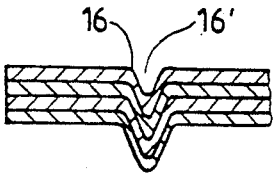

FIG. *2a* is an enlarged fragmentary view of FIG. 2 showing an encircled detail of the support for one of the stamping knives thereof;

FIG. 3 is a plan view of a web showing a trimming pattern therefor;

FIG. 4 is a perspective view of a many-sided or multiply-folded signature which does not have to be joined at the fold; and FIG. 5 is a much-enlarged sectional view of FIG. 3 taken along the line V—V and showing stamped-out tongue-like elements or tabs appended to the web and projecting through holes stamped out of the web.

Figure 1:
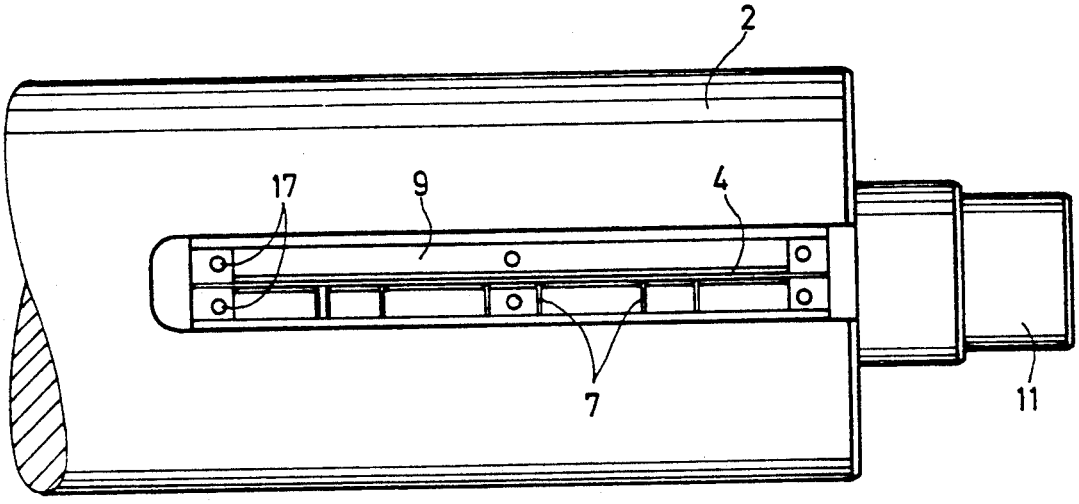
FIG. 1 is a fragmentary front elevational view of a cutting cylinder provided with stamping knives or dies in accordance with the invention.

Referring now to the drawing and, first, particularly to FIG. 1 thereof, there is shown therein, in a front elevational view, a cutting cylinder 2 provided with a cutting knife or blade 4. The cutting knife 4 is held by a clamping rail 9 on the cutting cylinder 2. The clamping rail 9 is secured by clamping screws 17 to the cutting cylinder 2. Below the cutting knife 4, which extends substantially horizontally across the cutting cylinder 2, several stamping or punching knives or dies 7 are disposed at varying lateral distances from one another. The particular number of stamping dies 7 held by the clamping rail 9 may vary over the length of the cutting cylinder 2. Thus, for example, in the vicinity of the edges of the paper web, a greater concentration of stamping dies 7, may be arranged to prevent the leading travel edge 14 of a product or signature from opening (note FIG. 4).

At the ends of the cutting cylinder 2, journals 11 (only one thereof shown in FIG. 1) are provided by means of which the cutting cylinder 2 is journaled in non-illustrated housing walls of a folding device or folder.

In the side or end elevational view of the cutting-cylinder pair of FIG. 2, the cutting cylinder 2 is shown cooperating with a grooved or notched cylinder 3. A paper web 1 formed of several layers or surface portions runs through the nip between the cutting cylinder 2 and the grooved cylinder 3. One or more of the cutting knife blades 4 are held in the clamping rail 9 of which only one is shown in FIG. 2, while the grooved cylinder 3 has one or more rubber beams or bars 5 disposed in one or more grooves formed on the outer cylindrical surface of the cylinder 3 equal to the number of the cutting knives 4. Moreover, one or more stamping knives or dies 7 are fastened upstream of the cutting knife or knives 4, in the direction of travel of the web 1 as represented by the associated curved arrow, in the clamping rail 9 which is received in a recess 10 formed in the cutting cylinder 2. Before a web section 8 is cut from the paper web 1 by the cutting blade 4 and the rubber bar 5 at a cutting station 6, the stamping knives or dies 7 which are distributed over the length of the cutting cylinder 2 penetrate the paper web 1 along a strip thereof directly upstream of the cutting station 6 at which there is about to be produced a newly formed leading edge of the paper web 1.

As the stamping dies 7 penetrate the paper web 1 they engage the rubber beam or bar 5 of the grooved cylinder 3 which is suitably timed to arrive at a location directly opposite the stamping dies 7. The stamping knives or dies 7 can be stuck fully through the paper web 1 without damage to the cutting edge or surface thereof, because the rubber beam or bar 5 provides an effective lining or cushion therefor. Due to the holes or slits 16 produced by the penetration of the paper web 1 and the formation of a tongue-like element or tab 16' remaining appendant to the paper web 1 yet extending through the holes or slits 16, the paper layers or surface portions of the paper web 1 are fastened or tacked together, because the individual paper layers are hooked together by the tongue-like elements at the edges of the holes or slits 16. The stamped-out holes or slits 16 hold the respective newly formed leading edges of the paper web 1 after the web section or signature 8 has been severed therefrom, so that the pages of the signature 8 cannot spread apart or be caused to flutter due to air resistance as the signature 8 is further transported or processed.

The stamping knife or die 7 is attached upstream of the cutting knife 4 in the travel direction of the paper web 1, as shown in FIG. 2. It is also possible, however, to arrange the stamping knife or die 7 downstream or after the cutting knife 4 in the clamping rail, so that the trailing edge of the web section or signature 8 can likewise be tacked together by stamping or punching.

Figure 2A:
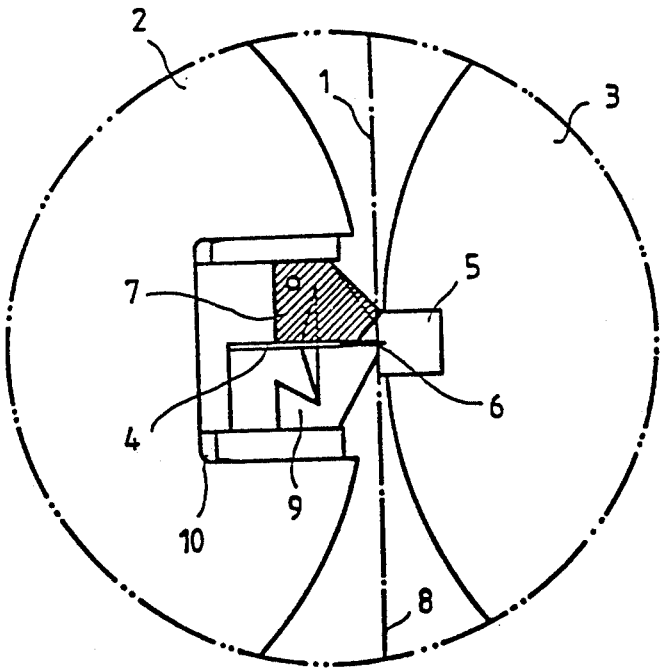

In FIG. 2*a*, the mounting support for the stamping knife or die 7 in the cutting cylinder 2, is shown in an enlarged view. The configuration of the stamping knife or die 7 is readily apparent from FIG. 2*a*. It is noted moreover, that the stamping die 7 may be formed of needles.

FIG. 3 shows a trimming pattern for a product or signature 12 which is to be produced. The signature 12 is formed with stamped-out holes or slits 16 in a trimming region or strip 13. It is, furthermore, apparent that holes or slits 16 lie behind or upstream of the leading edge 14 of the product or signature 12, in the travel direction thereof represented for the arrows. Tongue-like appendages of the paper web 1 formed by the stamping and extending into the holes or slits of the adjacent pages of the signature 12 prevent the leading edge 14 of the signature 12 from fluttering or opening during the further transport of the signature 12 in the folder. Water or any suitable adhesive may also be applied to the strip 13 to hold the pages of the signature together. The punched-out holes or slits 16 are formed in non-printed areas of the signature 12. In the course of subsequent processing of the signature 12, strips of the non-printed portions of the signature 12 in which the holes or slits 16 have been stamped are either trimmed or are retained as gluing or binding regions for gluing or binding together pages of multipage signatures 12.

In FIG. 4, a completed multipage signature 12 is illustrated. The aforementioned leading edge 14 is located at the lower end of the signature 12 shown in FIG. 4. At the left-hand side thereof is a fold edge 18, and an open side edge 19 is located opposite thereto. By stamping-out holes or slits in the strip adjacent to the leading edge 14, especially in vicinity of the open side edge 19, prevents the signature 12 from opening or the occurrence of "dog ears". Higher speeds are consequently able to be achieved in the folder, as well as more uniform product runs with improved product quality.

In the enlarged cross-sectional view of FIG. 5, a signature is shown formed with holes or slits 16 with the tongue-like elements or tabs 16' extending therethrough.

We claim:

1. Device for assuring orderly web travel in a given direction in a folder, comprising at least one cutting cylinder, at least one cutting knife disposed on said cutting cylinder, a grooved cylinder disposed in cooperative engagement with said cutting cylinder, said grooved cylinder carrying at least one rubber beam in a groove formed in said grooved cylinder, said cutting cylinder and said grooved cylinder being contrarotatable so that said cutting knife and said rubber beam are periodically in mutual engagement at a cut-off location, and at least one stamping die disposed in vicinity of said cut-off location and extending across substantially the entire width of a path traversible by a layered structure formed of mutually superimposed web surface portions travelling through a nip between said cylinders for stamping holes out of the layered structure while leaving a tongue-like element appendant to the web surface portions and projecting through the holes adjacent a location of the web surface portions at which a signature is cut-off by said cutting knife.

2. Device according to claim 1, wherein said stamping die is located on said cutting cylinder upstream of said cutting knife in the direction of travel of the web surfaces portions through said nip so as to stamp the holes out of the web surface portions before said cutting knife cuts off the signature.

3. Device according to claim 1, wherein said stamping die is located on said cutting cylinder adjacent said cutting knife so as to stamp the holes out of the web surface portions and cut the signature off approximately simultaneously.

4. Device according to claim 1, wherein said stamping die is located on said cutting cylinder downstream of said cutting knife in the direction of travel of the web surface portions through said nip so as to stamp the holes out of the web surface portions after said cutting knife cuts off the signature.

5. Device according to claim 1, including a clamping rail mounted on the outer cylindrical surface of said cutting cylinder, said stamping die being held in said clamping rail.

6. Device according to claim 5, wherein said clamping rail is mounted on said outer cylinder surface of said cutting cylinder substantially parallel to a rotational axis thereof, and a plurality of said stamping dies are distributed over the length thereof at mutually adjacent locations.

7. Device according to claim 1, wherein said stamping die is mounted on said cutting cylinder for cooperative engagement with said rubber beam periodically.

8. Device according to claim 1, wherein a plurality of said stamping dies are disposed on the outer cylindrical surface of said cutting cylinder for stamping out holes with tongue-like elements appendant to the web surface portions and projecting through the respective holes along respective strips of the web surface portions in vicinity of said cut-off location.

9. Device assuring orderly web travel in a given direction in a folder, comprising a first movable member carrying at least one cutting knife, a second movable member cooperatively engageable with said first movable member and carrying at least one beam formed of yieldable material, said first and said second movable members being movable relatively to one another so that said cutting knife and said beam formed of yieldable material are periodically in mutual engagement at a cut-off location along a travel path of a layered structure formed of mutually superimposed web surface portions, at least one stamping die disposed at another location along said travel path and extending across substantially the entire width of said travel path for stamping holes out of said web surface portions along respective strips thereof while leaving a tongue-like element appendant to the web surface portions and projecting through the holes.

10. In a method of assuring orderly web travel in a given direction in a folder, the improvement therein which comprises the steps of stamping out of a layered structure formed of mutually superimposed web surface portions, along respective strips thereof and across substantially the entire width of the layered structure, a plurality of tongue-like elements remaining appendant to the web surface portions and projecting through respective holes simultaneously stamped out of the web surface portions so as thereby to hold the web surface portions together at the respective strips thereof, severing the superimposed web surface portions into respective signatures along the respective strips so that leading ends of the of the respective signatures are held together by the tongue-like elements projecting through the stamped-out holes, and continuing to hold the leading end of the respective signatures together by maintaining the tongue-like elements in the stamped-out holes while simultaneously advancing the respective signature in the given direction.

11. Method according to claim 10, which comprises performing the step of severing the superimposed web surface portions into respective signatures along the respective strips so that leading ends of the respective signatures are held together by the tongue-like elements projecting through the stamped-out holes, prior to the stamping step.

12. Method according to claim 10, which comprises performing the step of severing the superimposed web surface portions into respective signatures along the respective strips so that leading ends of the respective signatures are held together by the tongue-like elements projecting through the stamped-out holes, during the stamping step.

13. Method according to claim 10, which comprises performing the step of severing the superimposed web surface portions into respective signatures along the respective strips so that leading ends of the respective signatures are held together by the tongue-like elements projecting through the stamped-out holes, after the stamping step.

14. Method according to claim 10, which includes transporting the thus formed signatures to a further processing location.

15. Method according to claim 14, which includes a step of applying a substance to the respective strips at leading edges of the thus formed signatures for causing the leading edges to adhere to one another.

16. Method according to claim 15, wherein the substance which is applied is an adhesive.

17. Method according to claim 15, wherein the substance which is applied is water.

18. Method according to claim 14, which includes trimming the strips from the respective signatures.

* * * * *